US008984723B2

(12) United States Patent
Pitman et al.

(10) Patent No.: US 8,984,723 B2
(45) Date of Patent: Mar. 24, 2015

(54) ADJUSTABLE STRAP ASSEMBLY, SLIDER AND CONNECTOR

(75) Inventors: Raymond David Pitman, Hunton Bridge (GB); Andrew Michael Honour, Amersham (GB)

(73) Assignee: Talon International, Inc., Woodland Hills, CA (US)

( * ) Notice: Subject to any disclaimer, the term of this patent is extended or adjusted under 35 U.S.C. 154(b) by 0 days.

(21) Appl. No.: 13/450,628

(22) Filed: Apr. 19, 2012

(65) Prior Publication Data

US 2012/0297581 A1 Nov. 29, 2012

Related U.S. Application Data

(63) Continuation of application No. PCT/GB2010/051726, filed on Oct. 13, 2010.

(30) Foreign Application Priority Data

Oct. 21, 2009 (GB) ..... 0918433.4

(51) Int. Cl.
*A44B 11/04* (2006.01)
*A41F 15/00* (2006.01)

(52) U.S. Cl.
CPC ..... *A41F 15/002* (2013.01); *A44B 11/04* (2013.01)
USPC ..... 24/200; 24/302

(58) Field of Classification Search
CPC ..... A44B 11/04; A44B 11/02; A44B 11/006; A44B 2300/32; B60P 7/0823; A41F 15/02; A41F 1/006; B65D 63/16; A61J 17/00; A41C 3/00
USPC ..... 24/200, 302, 198, 194–196, 185, 24/265 AL, 199, 186, 190, 265 EC, 265 BC; 450/86
See application file for complete search history.

(56) References Cited

U.S. PATENT DOCUMENTS

| | | | | | |
|---|---|---|---|---|---|
| 3,376,613 | A * | 4/1968 | Lindblad | 24/308 |
| 4,315,351 | A * | 2/1982 | Bartolini | 24/198 |
| 4,395,803 | A * | 8/1983 | Krauss | 24/200 |
| 4,457,051 | A * | 7/1984 | Bartolini | 24/198 |
| 4,525,901 | A * | 7/1985 | Krauss | 24/200 |
| 4,673,448 | A * | 6/1987 | Bartolini | 156/73.1 |
| 4,843,689 | A * | 7/1989 | Fildan | 24/200 |
| 5,216,786 | A * | 6/1993 | Anscher | 24/200 |
| 5,243,741 | A * | 9/1993 | Fudaki et al. | 24/200 |
| 5,307,542 | A * | 5/1994 | Murai | 24/200 |
| 5,590,443 | A * | 1/1997 | Fildan | 24/200 |
| 5,899,791 | A * | 5/1999 | Fildan | 450/82 |
| 6,163,937 | A * | 12/2000 | McKinnis et al. | 24/302 |
| 6,179,687 | B1 * | 1/2001 | Lee et al. | 450/88 |
| 6,904,648 | B2 * | 6/2005 | Fildan et al. | 24/302 |
| 7,140,080 | B2 * | 11/2006 | Fildan et al. | 24/302 |
| 7,552,515 | B2 * | 6/2009 | Funo | 24/200 |
| 2005/0086772 | A1 * | 4/2005 | Yoshiguchi | 24/197 |

* cited by examiner

*Primary Examiner* — Robert J Sandy
*Assistant Examiner* — Rowland Do
(74) *Attorney, Agent, or Firm* — Siritzky Law, PLLC

(57) ABSTRACT

An adjustable strap assembly has a strap, a slider, and an end connector for connection to a garment. An end of the strap is attached to the slider, and the strap passes through the end connector and through the slider. The end connector has a bar around which the strap passes, and defines a slot in front of the bar under an outer plate, such that the portions of the strap on either side of the bar both pass through the slot. The slot holds the two parts of the strap together and flat, making the assembly thinner.

23 Claims, 5 Drawing Sheets

ADJUSTABLE STRAP ASSEMBLY, SLIDER AND CONNECTOR

This application is related to and claims priority from International Application Number PCT/GB2010/051726, filed Oct. 13, 2010, titled "Adjustable Strap Assembly, Slider and Connector," published Apr. 28, 2011 as WO 2011/048406 A1, and which designated the United States, and which claims priority from GB 0918433.4, filed Oct. 21, 2009. The entire contents of International Application Number PCT/GB2010/051726 which are hereby fully incorporated herein by reference for all purposes.

The present invention relates to an adjustable strap assembly, particularly but not exclusively for use in clothing, and to a slider and a connector for use in an adjustable strap assembly.

It is known to provide adjustable strap assemblies that include a slider, for example for shoulder straps of a garment. Typically one end of the strap is connected to the slider, and the strap passes through a ring that is attached to one part of the garment, then through the slider, and is then attached to another portion of the garment. Movement of the slider along the strap adjusts the effective length of the strap. The slider may for example consist of a frame with a central bar and a pair of parallel slots or gaps, one on either side of the bar. The end of the strap may be fixed onto the central bar, while the adjustable portion of the strap passes through one slot, over the central bar, and then through the other slot. The attachment of the end of the strap to the central bar may be by looping around the bar and stitching the free end of the strap to the adjacent portion of the strap. The end of the strap may instead be welded onto the central bar, as described for example in U.S. Pat. No. 7,140,080. Alternatively the end of the strap may be attached to a projecting flange at one end of the slider, as described in U.S. Pat. No. 6,056,626.

Such adjustable strap assemblies are used in undergarments, for example in a brassiere worn under a blouse. However they tend to produce a bulge in the over garment (such as the blouse) at the positions of the slider and the attachment ring, which may be unsightly. An object of the present invention is to provide an adjustable strap assembly that is less noticeable, because the assembly is slimmer and produces less of a bulge.

According to the present invention there is provided an adjustable strap assembly comprising a strap, a slider, and an end connector which may be connected to a garment, wherein an end of the strap is attached to the slider, and the strap passes through the end connector and through the slider, wherein the end connector comprises a bar around which the strap passes, and comprises an outer plate such that the portions of the strap on either side of the bar both pass below the outer plate at a front end of the connector.

The end connector is itself attached, directly or indirectly, to the garment. For example a short length of connecting strap may be attached, for example by welding, onto the end connector at the end opposite the front end, the other end of the connecting strap being sewn onto the garment. In a preferred embodiment the end connector also comprises a front guide element spaced apart from the front end of the outer plate so as to define a slot, and the two portions of the strap pass through this slot. The bar within the end connector may be of rounded cross-section, but it preferably has at least one edge or corner around which the strap passes, for example being of square or rectangular cross-section. Such an edge or corner enhances the friction within the end connector. Since the two portions of the strap both pass under the outer plate, they are held flat and on top of each other, so the end connector is comparatively slim. Since the adjustable strap assembly of the invention is slimmer, it produces less of a bulge; also, being slimmer, the assembly is more comfortable to wear, which provides another advantage. Furthermore, the friction where the strap passes through the end connector may be greater than or similar to the friction where the strap passes through the slider.

The slider comprises a frame and a crossbar, one end of the strap being connected to the slider, and the strap passing through the end connector and then through the slider, the strap passing around the crossbar. The strap may be said to pass under the ends of the frame and over the crossbar—the face of the slider that faces those portions of the strap may be referred to as the lower surface of the slider, while the opposite face of the slider may be referred to as its outer surface. The end of the slider closest to the end connector may be referred to as the rear end of the slider, and the end furthest from the end connector may be referred to as the front end of the slider.

Preferably the slider tapers towards both ends, and the crossbar is attached to the frame such that a portion of the strap passing over the crossbar does not protrude above the outer surface of the slider. Preferably the outer surface of the frame is curved in longitudinal profile. These features ensure that there are no abrupt changes in thickness of the strap assembly.

Preferably the crossbar is of wedge-shaped or triangular cross-section. Preferably it has a sloping front face (the face nearer the front end of the slider). The rear face (the face nearer the rear end of the slider) is preferably more steeply sloped, and may be substantially orthogonal to a longitudinal axis of the slider. Desirably the front face and the rear face of the crossbar meet at an edge at the outer surface of the crossbar. Hence the strap passing over the crossbar undergoes an abrupt change of direction at this edge; this enhances friction between the strap and the slider.

Preferably part of the lower surface of a front portion of the frame slopes, so that in use the strap extends in contact with or close to the lower surface of the front portion of the frame over at least part of its length. This ensures a smooth transition between the strap outside the slider and the sloping portion of strap leading up to the crossbar. Indeed a part of the lower surface of the front portion may be substantially parallel to the sloping front face of the crossbar. And preferably the lower surface of the frame is curved in longitudinal profile, so that the ends of the frame are above the lowermost portion of the slider. This ensures that the strap emerging from the end of the slider does not increase the overall thickness of the assembly.

Preferably the lower surface of the rear portion of the frame also slopes, so that the strap extends in contact with at least part of the lower surface of the rear portion. And preferably the attached end of the strap is attached to the underside of the slider at the rear edge of the slider; the slider preferably defines a flange to locate an end of the strap, the end of the strap being fixed to the flange. This may be by ultrasonic welding.

The outer surface of the frame may form a continuous surface between the front and the back of the slider; this helps ensure a smooth profile to the assembly. Alternatively the outer surface may define an aperture; this makes it easier to feed the strap through the slider. It is desirable if the aperture does not extend the full width of the crossbar, so that in use at least the edges of the strap that pass over the crossbar are hidden, but alternatively the aperture may have a width substantially equal to that of the crossbar. Particularly where the aperture does not extend the full width of the crossbar, the aperture may have a decorative appearance.

In a second aspect the invention provides a slider for use in an adjustable strap assembly; and in a third aspect provides an end connection for use in an adjustable strap assembly. It will be appreciated that the slider of the invention may be used in conjunction with an end connector that does not conform to the present invention; and it will be appreciated that the end connector of the invention may be used in conjunction with a slider that does not conform to the present invention.

The invention will now be further and more particularly described, by way of example only, and with reference to the accompanying drawings in which.

Figure 1:
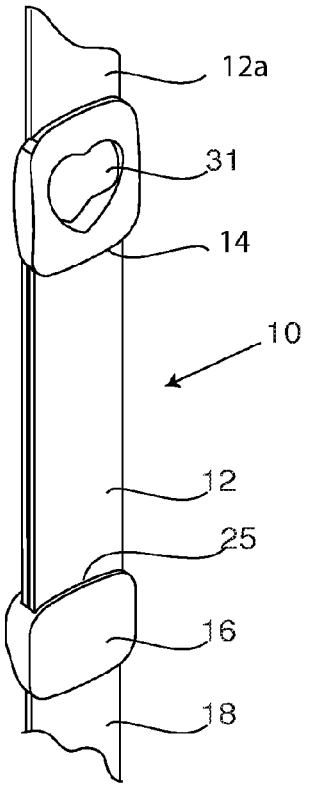
FIG. 1 shows a side elevation of an adjustable strap assembly of the invention.

Referring now to FIG. 1 there is shown an adjustable strap assembly 10 that may be used in a brassiere to provide a shoulder strap. The assembly 10 consists of a strap 12, a slider 14, and an end connector 16 for connection to the garment (not shown), such as the brassiere. The slider 14 and the end connector 16 are of a plastics material, such as nylon, and can be formed by moulding. One end 12*a* of the strap 12 is attached to the slider 14, and the strap 12 passes through the end connector 16 and through the slider 14. The other end of the strap (not shown) is connected to the garment at another position. The end connector 16 is connected to a short length of connecting strap 18, and the other end of the connecting strap 18 is sewn into the garment. If the strap assembly 10 forms a shoulder strap, then typically the end connector 16 would be attached either directly, or by means of a connecting strap 18, to a position at the front of the garment, and the other end of the strap would be connected to a position at the back of the garment. To adjust the length of the strap assembly 10 the slider 14 would be moved along the strap 12, and the strap 12 would also be eased through the end connector 16 to ensure that the two portions of strap 12 between the slider 12 and the end connector 16 remain of equal length. There is sufficient friction between the slider 14 and the strap 12, and also between the end connector 16 and the strap 12, that the strap assembly 10 remains at the length set by the user; but the friction is not so great as to prevent the user from adjusting the length.

Figure 2:
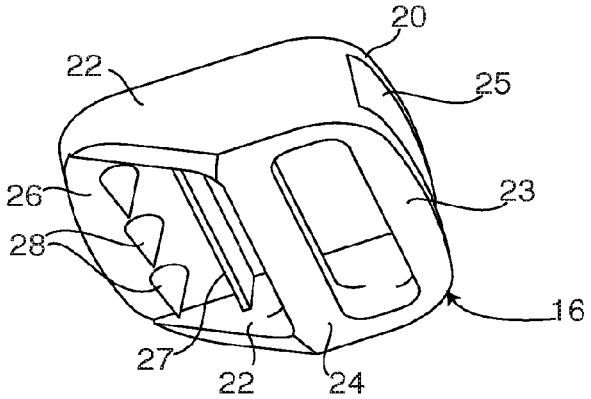
FIG. 2 shows a perspective view showing the underside of the end connector of the assembly of FIG. 1.
Figure 3:
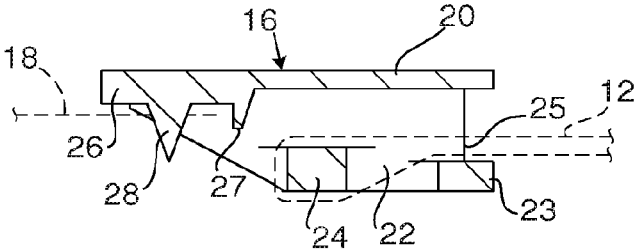
FIG. 3 shows a longitudinal sectional view of the end connector of FIG. 2.

Referring now to FIG. 2, the end connector 16 consists of an outer plate 20 from which project sidewalls 22. The lowermost parts of the sidewalls are linked by a crossbar 24 and by a front guide plate 23, so that there is a generally rectangular slot 25 at the front of the end connector 16 defined between the outer plate 20 and the front guide plate 23. By way of example the total thickness of the end connector 16 may be less than 5 mm, for example less than 4 mm, and in one example is 3.5 mm. As shown in FIG. 3, in which the line followed by the strap 12 is shown by a broken line, the strap 12 extends through the slot 25, passes around the crossbar 24, and extends back through the slot 25. Thus the portions of the strap 12 on either side of the crossbar 24 both pass through the slot 25.

The underside of the outer plate 20 at the opposite end from the slot 25 defines a flange 26 whose front edge is delimited by a rim 27, and on which are three conical projections 28. The connecting strap 18 is placed on this flange 26 with its end up against the rim 27, and is subjected to ultrasonic welding. This causes the conical projections 28 to melt and the molten material becomes embedded in the strap 18, so the strap 18 is securely fixed to the end connector 16. It will thus be appreciated that in the finished product (as in FIG. 1) the conical projections 28 no longer exist.

In use of the end connector 16 there is friction particularly where the strap 12 passes around three corners of the crossbar 24, and around the rear corner of the front guide plate 26; there is also friction between the two straps 12 where they pass through the slot 25. It will also be appreciated that the slot 25 ensures that the two parts of the strap 12 are flat and lie on top of each other.

Figure 4:
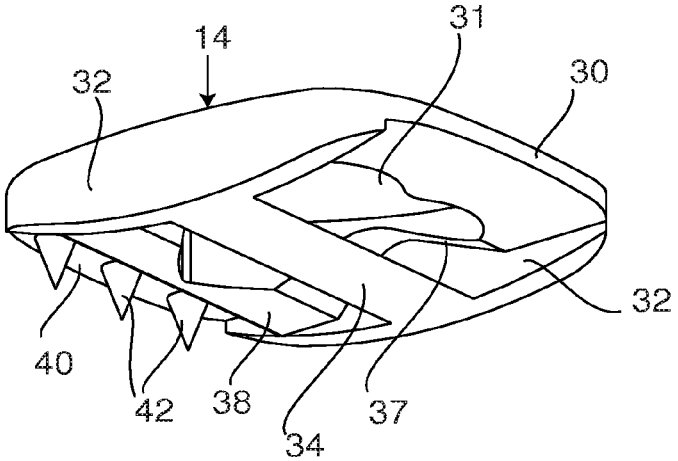
FIG. 4 shows a perspective view showing the underside of the slider of the assembly of FIG. 1.
Figure 5:
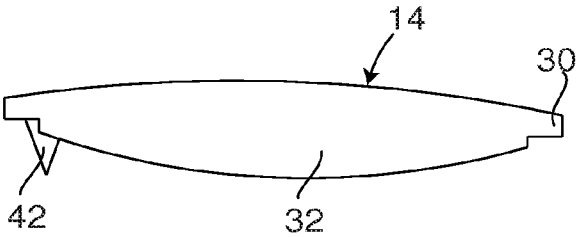
FIG. 5 shows a side view of the slider of FIG. 4.

Referring now to FIG. 4, the slider 14 consists of an outer plate 30 which (as shown particularly in FIG. 1) defines a heart-shaped aperture 31. Along each side are sidewalls 32 which are linked by a crossbar 34 about halfway along the slider 14. Referring also to the side view of FIG. 5 the sidewalls 32 are of greatest height around the midpoint of the slider 14, and decrease in height towards both ends, the shape of the outer plate 30 and the sidewalls 32 being such that both the outer surface and the lower surface are curved from a thick region around the midpoint of the slider 14 to thinner regions at both ends. By way of example the slider 14 may be of thickness, at its maximum point, less than 5 mm, more preferably less than 4 mm, and in one example is about 2.8 mm thick.

Figure 6:
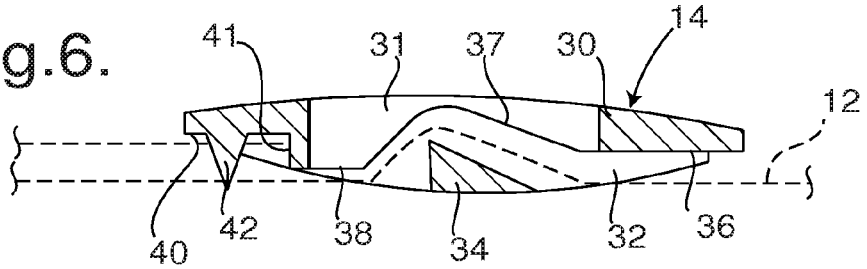
FIG. 6 shows a longitudinal sectional view of the slider of FIG. 4.

Referring also to FIG. 6, the crossbar 34 is of wedge-shaped cross-section, with a gentle slope on its front face, whereas its rear face is perpendicular to the longitudinal axis of the slider 14. In this example the front face is inclined at about 25° to the longitudinal axis, although it will be appreciated that the front face might be inclined at a different angle, although preferably between 20° and 35°. The underside of the crossbar 34 is at the lowermost part of the slider 14 such that if the slider 14 rests on a surface parallel to its longitudinal axis, there is a gap between the surface and the underside of the outer plate 30 at both ends of the slider 14, and the strap 12 can therefore pass through these gaps (its path being shown by the broken line). The under surface of the outer plate 30 has a portion 36 parallel to the longitudinal axis at the front of the slider 14; it then has a portion 37 that slopes upwardly, approximately parallel to the front face of the crossbar 34, and then curves over the top corner of the crossbar 34 and slopes downwardly towards the rear of the slider 14. There is then a portion 38 parallel to the longitudinal axis. The rear-most portion of the outer plate 30 defines, on its underside, a flange surface 40 parallel to the longitudinal axis, terminating in a step 41 leading to the portion 38, and on the flange surface 40 are a number of conical projections 42.

The portion of the strap 12 that is to be attached to the slider 14 is placed on the flange surface 40 with the end of the strap 12 up against the step 41, and is subjected to ultrasonic welding. As described above this causes the conical projections 42 to melt and the molten material becomes embedded in the strap 12, so the end of the strap 12 is securely fixed to the underside of the rear end of the slider 14. It will be appreciated that in the assembled product the conical projections 42 no longer exist.

In use of the slider 14 the strap 12 follows the broken line, passing under the flat portions 36 and 38 at the front and towards the rear of the slider 14, respectively; and passing over the crossbar 34. There is consequently friction between the strap 12 and the corner along the top edge of the crossbar 34, where the strap 12 has to undergo an abrupt change of direction. The friction in the slider 14 in combination with the friction between the strap 12 and the end connector 16 together ensure that the strap assembly 10 remains at the length set by the user. Nevertheless the user is not prevented from adjusting the length of the strap.

Figure 7:
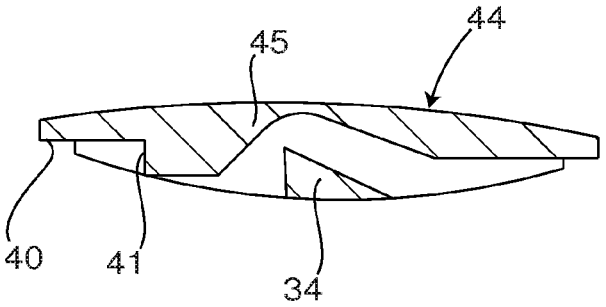
FIG. 7 shows a longitudinal sectional view of a modification to the slider of FIG. 4.

It will be appreciated that the strap assembly 10 described above, and in particular the slider 14 and the end connector 16, are by way of example only, and that they may be modified in various ways while remaining within the scope of the present invention. By way of example, referring now to FIG. 7, there is shown a slider 44 which differs from the slider 14 in that there is no aperture 31, so that the outer plate 45 provides a continuous and smooth outer surface. As in the slider 14, the crossbar 34 is of wedge-shaped cross-section, and is at the lowermost part of the slider 44; and the under surface of the outer plate 45 has the same shape as that of the outer plate 30, defining a continuous smooth curve from a region in front of the crossbar 34 to a region behind it. Again there is a flange surface 40 terminating in a step 41, onto which the end of the strap 12 may be welded; this surface 40 may be provided with conical projections 42 (not shown in FIG. 7).

Figure 8:
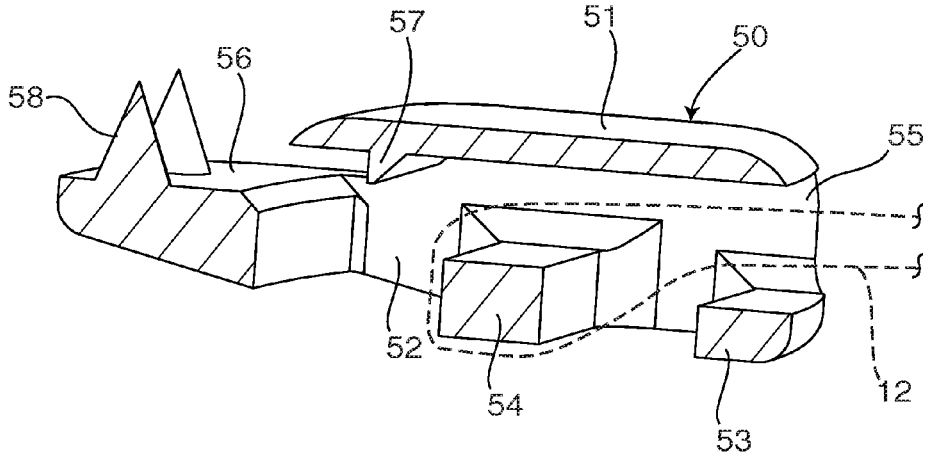
FIG. 8 shows a longitudinal section of a perspective view of an alternative end connector for use in the adjustable strap assembly of FIG. 1.

Referring now to FIG. 8 there is shown an alternative end connector 50 in which the connecting strap 18 (or the garment) may be attached to the outer face of the end connector. The end connector 50 consists of an outer plate 51 from which project sidewalls 52, linked together at their lower edge by a crossbar 54 and by a front guide plate 53, so that there is a generally rectangular slot 55 at the front of the end connector 50 defined between the outer plate 51 and the front guide plate 53. The sidewalls 52 project rearwardly beyond the outer plate 51, and at the rear of the connector 50 they are joined by a rear flange 56, on whose upper surface are a number of conical projections 58. The upper surface of the rear flange 56 is lower than the underside of the outer plate 51, the gap between them being approximately equivalent to the thickness of the connecting strap 18, so that the strap 18 can be placed on the rear flange 56 with its end locating under the rear edge of the outer plate 51 up against a lip 57 that projects from the lower surface of the outer plate 51.

The strap 18 is then welded onto the rear flange 56 as described above, so that the conical projections 58 no longer exist in the final product. The end of the strap 18 is not exposed, because it is concealed by the rear edge of the outer plate 51. The strap 12 is fed through the end connector 50 in the same way as described above, passing through the slot 55, around the crossbar 54, and back out through the slot 55, as indicated by the broken line.

Figure 9:
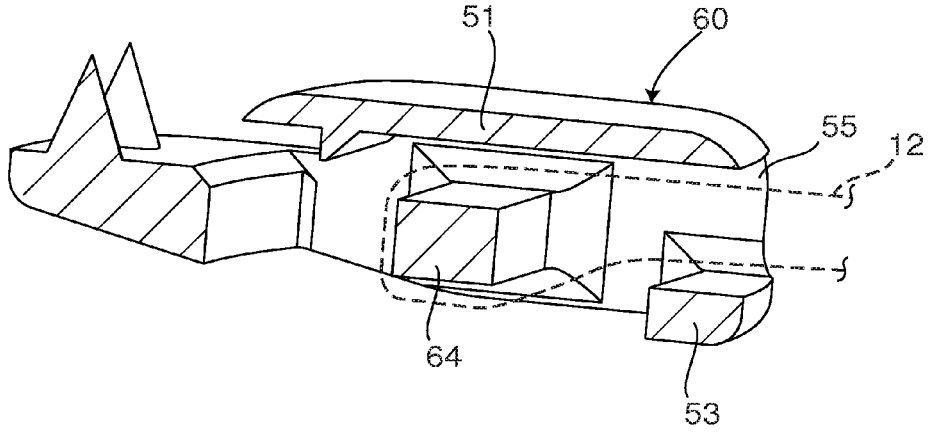
FIG. 9 shows a modification of the end connector of FIG. 8.
Figure 10:
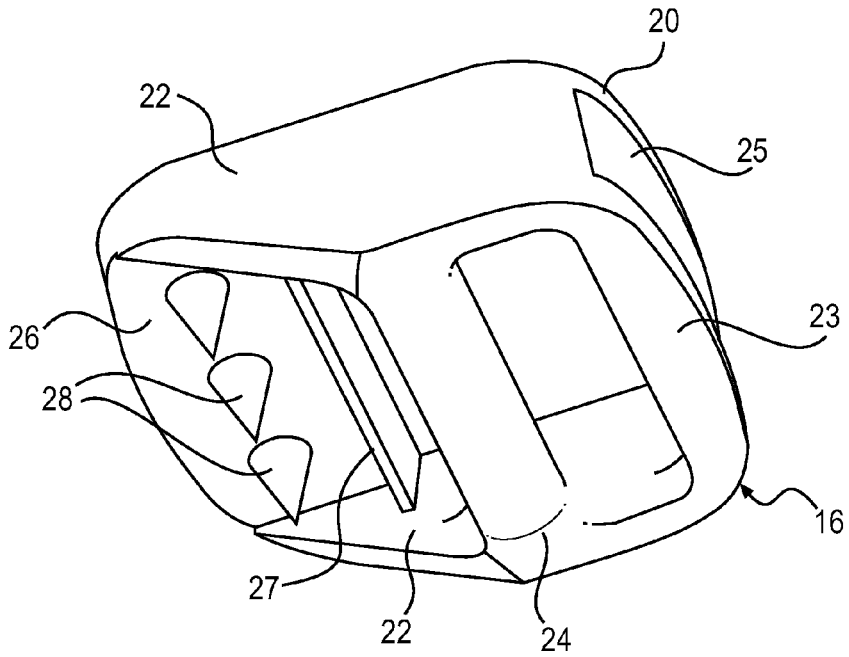
FIG. 10 shows a perspective view showing the underside of an end connector.
Figure 11:
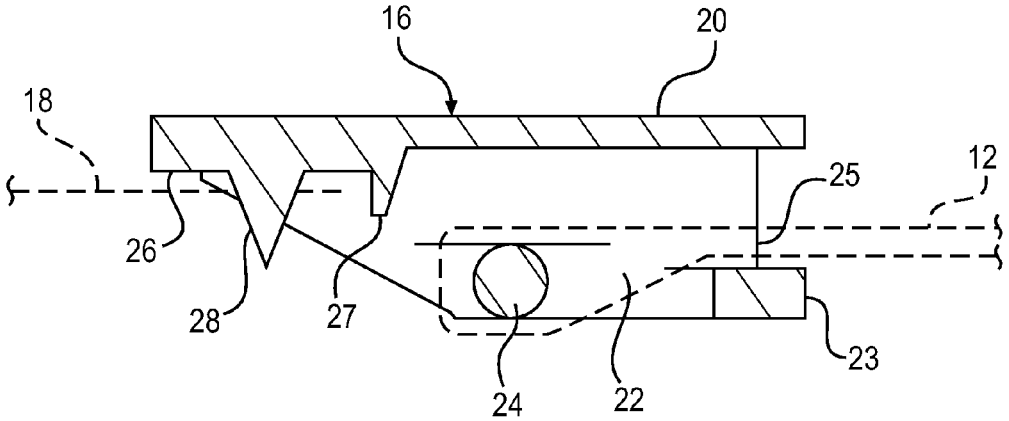
FIG. 11 shows a longitudinal sectional view of the end connector of FIG. 10.
Figure 12:
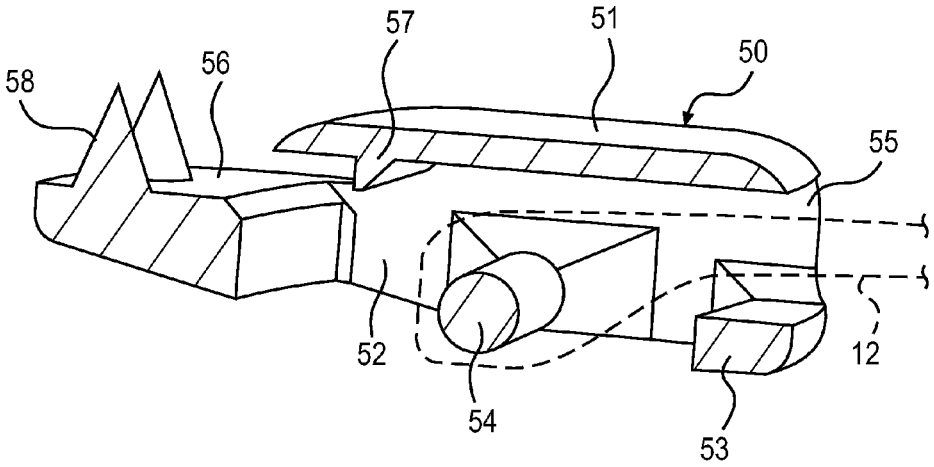
FIG. 12 shows a longitudinal section of a perspective view of an alternative end connector.
Figure 13:
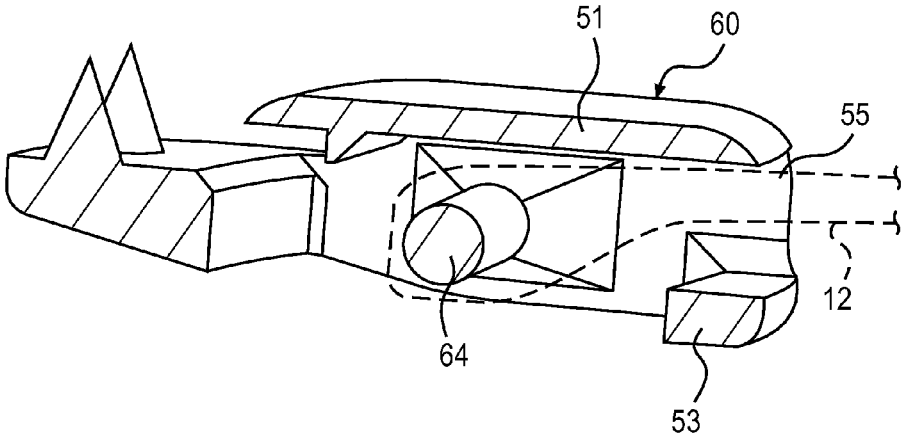
FIG. 13 shows a modification of the end connector of FIG. 12.

Referring now to FIG. 9 there is shown an alternative end connector 60, which has many features in common with the end connector 50. It differs in that the crossbar 64 is closer to the outer plate 51, and so higher relative to the under surface of the front guide plate 53. This reduces the change of direction of the portion of the strap 12 that extends from the slot 55 to the underside of the crossbar 64. It also reduces the extent to which the strap 12 that passes below the crossbar 64 projects lower than the lower surface of the front guide plate 53. It will be appreciated that this modification—raising of the crossbar relative to the under surface of the connector—would be equally applicable to the end connector 16 of FIG. 2.

In a further modification to the end connector 16, 50 or 60, the front guide plate 23 or 53 may be omitted. Since the under surface of the end connector, in use, lies against the body or against another garment, the two portions of the strap 12 emerging from the front of the end connector would in any event be constrained to pass through a slot defined between the front edge of the outer plate 20 or 51 and the underlying body or garment. This modification would provide less friction than the previously-described end-connectors 16, 50 or 60.

In another alternative, the slider might also be arranged to have the strap 12 attached at a different position, for example to the outer surface. And indeed in both the slider and the end connector the strap 12 or 18 might instead be located in a slot defined in the outer plate, and welded into position. As regards the end connectors 16, 50 and 60 in each case the crossbar 24, 54, 64 is of generally rectangular cross-section (with a wider end portion where it joins onto the sidewalls 22, 52), but the crossbar might instead have a different cross-sectional shape, for example having the front corner rounded so that the bulk of the friction is only at the rear two corners, or indeed having two of the corners rounded, or even having all the corners rounded, so that the crossbar might be oval or circular in cross-section, the friction in this case being provided by the contact between the two parts of the strap 12 as they pass through the slot 25, 55. Similarly the front guide plate 23, 53 might have a different shape to that shown, for example being somewhat longer, or having a rounded corner around which the strap 12 passes.

We claim:

1. An adjustable strap assembly comprising a strap, a slider, and an end connector which may be connected to a garment, wherein an end of the strap is attached to the slider, and the strap passes through the end connector and through the slider, wherein:

the end connector comprises a bar around which the strap passes, and comprises an outer plate such that portions of the strap on either side of the bar both pass below the outer plate at a front end of the connector; and the slider comprises a frame, and a crossbar over which the strap passes, the crossbar being of wedge-shaped cross-section, wherein the frame defines end portions under which the strap passes, and wherein a lower surface of part of the front portion of the frame slopes upwardly and is substantially parallel to a sloping front face of the crossbar, and wherein the frame has an under surface that defines a continuous smooth curve from a region in front of the crossbar to a region behind the crossbar.

2. The strap assembly as claimed in claim 1 wherein the end connector also comprises a guide plate spaced apart from the outer plate to define a slot at the front end of the connector through which the two portions of the strap both pass.

3. The strap assembly as claimed in claim 2 wherein the bar within the end connector is of rounded cross-section.

4. The strap assembly as claimed in claim 2 wherein the bar within the end connector defines at least one edge or corner around which the strap passes.

5. The strap assembly as claimed in claim 2 wherein the frame has an outer surface, and wherein the outer surface covers at least the ends of the crossbar.

6. The strap assembly as claimed in claim 5 wherein the outer surface defines an aperture that is of decorative appearance.

7. The strap assembly as claimed in claim 1 wherein the bar within the end connector is of rounded cross-section.

8. The strap assembly as claimed in claim 1 wherein the bar within the end connector defines at least one edge or corner around which the strap passes.

9. The strap assembly as claimed in claim 1 wherein the slider has a thickness that tapers towards both ends.

10. The strap assembly as claimed in claim 1 wherein the slider has a lowermost portion around its midpoint, and has end portions that are above the lowermost portion.

11. The strap assembly as claimed in claim 1 wherein the frame has an outer surface, and wherein the crossbar is below the frame, and wherein the outer surface covers at least the ends of the crossbar.

12. The strap assembly as claimed in claim 11 wherein the outer surface defines an aperture that is of decorative appearance.

13. The adjustable strap assembly of claim 1 wherein said slider further comprises: sidewalls along each side thereof, said sidewalls being linked by said crossbar.

14. The adjustable strap assembly of claim 13 wherein said sidewalls are linked by said crossbar about half way along the slider.

15. The adjustable strap assembly of claim 13 wherein the sidewalls are of greatest height around a midpoint of the slider and decrease in height towards both ends of the slider.

16. The adjustable strap assembly of claim 13 wherein the outer surface of the slider and the lower surface of the slider are curved from a thick region around a midpoint of the slider to thinner regions at both ends of the slider.

17. The adjustable strap assembly of claim 1 wherein a thickness of the slider at a maximum point is less than 5 mm.

18. The adjustable strap assembly of claim 17 wherein the thickness of the slider at a maximum point is less than 4 mm.

19. The adjustable strap assembly of claim 1 wherein a thickness of the slider at a maximum point is less about 2.8 mm.

20. The adjustable strap assembly of claim 1 wherein a rear face of the crossbar is substantially perpendicular to a longitudinal axis of the slider.

21. The adjustable strap assembly of claim 1 wherein a front face of the crossbar is inclined at between about 20° and 35° to a longitudinal axis of the slider.

22. An adjustable strap assembly comprising a strap, a slider, and an end connector which may be connected to a garment, wherein an end of the strap is attached to the slider, and the strap passes through the end connector and through the slider, wherein:

(A) the end connector comprises:

(A)(1) a bar around which the strap passes;

(A)(2) an outer plate such that portions of the strap on either side of the bar both pass below the outer plate at a front end of the connector;

(A)(3) a guide plate spaced apart from the outer plate to define a slot at the front end of the connector through which the two portions of the strap both pass, wherein the bar within the end connector defines at least one edge or corner around which the strap passes; and (B) the slider comprises:

(B)(1) a frame, and (B)(2) a crossbar over which the strap passes, the crossbar being of wedge-shaped cross-section, the crossbar being below the frame, wherein the frame defines end portions under which the strap passes, and wherein a lower surface of part of the front portion of the frame slopes upwardly and is substantially parallel to a sloping front face of the crossbar, wherein a thickness of the slider at a maximum point is less than 5 mm; and the frame has an outer surface, and wherein the outer surface covers at least the ends of the crossbar.

23. An adjustable strap assembly comprising a strap, a slider, and an end connector which may be connected to a garment, wherein an end of the strap is attached to the slider, and the strap passes through the end connector and through the slider, wherein:

the end connector comprises a bar around which the strap passes, and comprises an outer plate such that portions of the strap on either side of the bar both pass below the outer plate at a front end of the connector;

the slider comprises a frame, and a crossbar over which the strap passes, the crossbar being of wedge-shaped cross-section, a rear face of the cross-bar being substantially perpendicular to a longitudinal axis of the slider, and a front face of the crossbar being inclined at between 20° and 35° to the longitudinal axis of the slider, wherein a thickness of the slider at a maximum point is less than 5 mm; and the frame defines end portions under which the strap passes, and wherein a lower surface of part of the front portion of the frame slopes upwardly and is substantially parallel to a sloping front face of the crossbar.

* * * * *